United States Patent [19]

McCabe

[11] Patent Number: 4,555,981

[45] Date of Patent: Dec. 3, 1985

[54] DAMPER OPERATOR FOR USE WITH AIR, SMOKE AND FIRE DAMPERS

[76] Inventor: Francis J. McCabe, 239 Hastings Ct., Doylestown, Pa. 18901

[21] Appl. No.: 639,909

[22] Filed: Aug. 10, 1984

Related U.S. Application Data

[60] Continuation-in-part of Ser. No. 229,830, Jan. 30, 1981, Pat. No. 4,472,999, which is a continuation-in-part of Ser. No. 16,514, Mar. 1, 1979, Pat. No. 4,301,569, which is a continuation-in-part of Ser. No. 896,299, Apr. 14, 1978, Pat. No. 4,195,384, which is a continuation-in-part of Ser. No. 799,044, Mar. 18, 1977, Pat. No. 4,099,292, which is a continuation-in-part of Ser. No. 676,483, Apr. 13, 1976, Pat. No. 4,401,570, and a continuation-in-part of Ser. No. 676,413, Apr. 13, 1976, Pat. No. 4,040,304, and a continuation-in-part of Ser. No. 764,774, Feb. 2, 1977, Pat. No. 4,114,646, which is a continuation of Ser. No. 689,994, May 26, 1976, Pat. No. 4,081,173, said Ser. No. 16,514, is a continuation-in-part of Ser. No. 896,237, Apr. 14, 1978, Pat. No. 4,219,041, and a continuation-in-part of Ser. No. 905,211, May 12, 1978, Pat. No. 4,183,129, which is a division of Ser. No. 729,831, Oct. 4, 1976, Pat. No. 4,113,232.

[51] Int. Cl.[4] ..... F24F 7/00

[52] U.S. Cl. ..... 98/1; 16/48.5; 49/7; 49/8; 137/75; 137/77; 236/101 R

[58] Field of Search ..... 16/48.5; 49/1, 2, 3, 49/4, 7, 8; 98/1, 86, 121.2; 137/74, 75, 76, 77, 79, 80, 601; 236/49, 93 R, 101 R, DIG. 2, DIG. 5; 251/66, 67, 68

[56] References Cited

U.S. PATENT DOCUMENTS

| | | | |
|---|---|---|---|
| 1,515,081 | 11/1924 | Toelle | 137/77 |
| 1,731,214 | 10/1929 | Eshbaugh | 136/93 R X |
| 2,901,064 | 8/1959 | Lasier | 16/48.5 |
| 3,012,446 | 12/1961 | Muehl | 137/77 |
| 3,718,081 | 2/1973 | Rout | 98/121.2 X |
| 3,889,314 | 6/1975 | McCabe | 16/48.5 |
| 3,951,051 | 4/1976 | Dry | 137/601 |

*Primary Examiner*—Harold Joyce
*Attorney, Agent, or Firm*—Benasutti and Murray

[57] ABSTRACT

A damper operator for use with a damper having a frame and a damper blade pivotally associated with the frame, which damper operator comprises a drive rod; a pair of lever arms which are pivotally associated with each and which extend between the drive rod and a pivoting mechanism associated with the blade of the damper; and a latching mechanism which extends between portions of each of the lever arms, and which permits selective engagement and disengagement between those portions of the lever arms, and accordingly, selective respective rotation of the lever arms, so that the blade of the damper can be urged toward a predetermined orientation; and biasing means to urge the damper closed when the arms are disengaged; and means to prevent the blade from opening when the arms are disengaged and the blade has been biased shut.

21 Claims, 8 Drawing Figures

DAMPER OPERATOR FOR USE WITH AIR, SMOKE AND FIRE DAMPERS

RELATED CASES

This application is a continuation-in-part application of my prior patent application Ser. No. 229,830, filed Jan. 30, 1981 now U.S. Pat. No. 4,472,999 which application is a continuation-in-part of an application Ser. No. 016,514, filed Mar. 1, 1979 which issued into U.S. Pat. No. 4,301,569, dated Nov. 24, 1981, entitled "Quadrant Operator", which patent application was a continuation-in-part of an application Ser. No. 896,299, filed Apr. 14, 1978 entitled "Self-Resetting, Cable Operated Translating Drive Link", now U.S. Pat. No. 4,195,384, dated Apr. 1, 1980; which in turn is a continuation-in-part of my prior patent application Ser. No. 799,044, filed Mar. 18, 1977, and entitled "Telescoping Heat Responsive Releasing Means", now U.S. Pat. No. 4,099,292, dated Jul. 11, 1978; which in turn is a continuation-in-part of my prior patent application Ser. No. 676,483, filed Apr. 13, 1976, and entitled "Resettable, Heat Actuatable Fire Link", now U.S. Pat. No. 4,401,570, dated Aug. 16, 1977, as well as a continuation-in-part of my prior patent application Ser. No. 676,413, filed Apr. 13, 1976, and entitled "Clutch Motor For Use in Resettable Fire Damper", now U.S. Pat. No. 4,040,304, dated Aug. 9, 1977, and is also a continuation-in-part of my prior patent application Ser. No. 764,774, filed Feb. 2, 1977, and entitled "Rotating Blade Fire Damper", now U.S. Pat. No. 4,114,646, dated Sept. 19, 1978; which in turn is a continuation of my prior patent application Ser. No. 689,994, filed May 26, 1976, and entitled "Rotating Blade Fire Damper", now U.S. Pat. No. 4,081,173, dated Mar. 28, 1978.

U.S. patent application Ser. No. 16,514 is also a continuation-in-part of my prior co-pending patent application Ser. No. 896,237, filed Apr. 14, 1978, and entitled "Electro-Thermal Fire Protection Locking Clip", now U.S. Pat. No. 4,219,041, dated Aug. 26, 1980, and is also a continuation-in-part of my prior patent application Ser. No. 905,211, filed May 12, 1978, and entitled "Method of Forming a Smoke, Fire and Air Control Damper With Stamped Blade Hinge", now U.S. Pat. No. 4,183,129, dated Jan. 15, 1980; which in turn is a division of my prior co-pending patent application Ser. No. 729,831, filed Oct. 4, 1976, and entitled "Smoke, Fire and Air Control Damper With Stamped Blade", now U.S. Pat. No. 4,113,232, dated Sept. 12, 1978.

The disclosures of the foregoing applications and patents are incorporated herein by reference as if fully set forth herein.

BACKGROUND OF THE INVENTION

The present invention relates generally to air, smoke and fire dampers, and more particularly, to an operator for use in conjunction with such dampers.

A variety of dampers have been developed for use in regulating the flow of air through a duct system, as well as for use in controlling the passage of fire or smoke through the duct system. Many duct systems are large enough to accommodate relatively large, multiple blade-type dampers, which generally include a plurality of hinged blades disposed within a frame. The damper blades are journalled for rotation within the frame of the damper, so that the blades can be opened or closed as desired. Examples of such dampers may be found, for example, in my U.S. Pat. No. 4,113,230, dated Sept. 12, 1978, and entitled "Rotating Blade Fire Damper"; and my U.S. Pat. No. 4,113,232, dated Sept. 12, 1978, and entitled "Smoke, Fire and Air Control Damper With Stamped Blade".

A variety of damper operators have been developed for use in regulating the positioning of the damper blades between their open and closed position. For example, the damper assemblies previously referred to incorporate an operator which generally comprises a series of brackets attached to each of the blades of the damper, and a connecting rod which is pivotally attached to each of the brackets, so that uniform articulation of the damper blades occurs in response to movement of the connecting rod. Movement of the connecting rod, and accordingly positioning of the damper blades, can then be regulated by any of a variety of control linkages, one example being the linkage shown in my U.S. Pat. No. 4,113,230.

Often, it is important to provide a damper operator which is capable of automatically responding to an external stimulus, such as the smoke or heat of a fire, so that the blades of the damper can be opened or closed, as indicated, both quickly and positively, irrespective of their existing position. One operator which has been developed for this purpose may be found in my U.S. Pat. No. 4,301,569, issued Nov. 24, 1981, entitled "Quadrant Operator". The operator disclosed generally includes a shaft-type actuating means which is selectively interconnected with the connecting rod which is used to regulate movement of the damper blades by a releasing device. The releasing device permits operation of the damper between its open and closed positions during normal conditions, however, upon sensing a selected stimulus, such as heat or smoke, the releasing device is caused to disengage from the connecting rod, so that the damper blades can be urged toward a selected position by an appropriate biasing means.

Such damper operators serve well to properly operate the damper in accordance with the ambient conditions present in the duct system. However, in order to permit the damper blades to be fully rotated between their open and closed position, such damper operators must generally rotate through an arc of approximately 90°, so that their rotation will permit full travel of the connecting rod between its terminating positions.

In accordance with the invention disclosed in my prior application Ser. No. 229,830, filed Jan. 30, 1981, a damper is provided with an operator which engages the blade of the damper and causes damper blade rotation during normal operating conditions, when no fire or smoke is detected, but which releases the damper blade, freeing the damper blade for rotation to a selected position, when fire or smoke is detected. To do so, the operator is provided with an articulating assembly which comprises a first arm attached to and extending outwardly transverse to the axis of a drive rod associated with the operator; a second arm, pivoted for rotation with respect to the first arm, having means for engaging the damper blade at one end, and a latch at the other end; and a release mechanism extending between the first arm and the latch of the second arm for selectively latching and releasing the two arms.

During normal operating conditions, the release mechanism is caused to engage the second arm, thus preventing rotation of the second arm with respect to the first arm. As a result, rotational movement of the arms is transmitted to the damper blade, which causes its rotation. Controlled movement of the arms thereby regulates the angular position of the damper blade within the damper opening. In the event that a fire, or other stimulus, is sensed, the release mechanism is caused to disengage from the second arm. This permits the second arm to freely rotate with respect to the first arm. This permits the damper blade to be urged toward a pre-selected orientation (in the case of fire—fully closed) by appropriate biasing means.

In the case of a fire, the air pressure in the side of the duct closest to the fire will normally be greater than the pressure in the duct on the side of the damper most remote from the fire. Accordingly, this differential air pressure tends to force the damper open from its fully closed position. It is desirable therefore to provide a mechanism for resisting the forces on the blade and preventing the blade from opening.

SUMMARY OF THE INVENTION

In accordance with the present invention, I provide a simple and effective way of preventing opening of the blade due to excessive air pressure during a fire. In accordance with my invention, I provide an over-center cam latch proximate to the terminal portion of the second arm most remote from the pivotal connection with the first arm. As described in my prior application, when the second arm is released from the first arm, a spring bias pivots the blade of the damper to its closed position. During this pivoting, the second arm tracks on a ferrule attached to a bracket which is attached to the blade. By placing a notch in the end of the second arm on the underside of the tracking slot in the arm, which will ride over-center of the ferrule before excessive pressure builds up, my device can prevent the blade from opening under pressure.

Accordingly, it is a primary object of the present invention to provide a damper operator of the type described which prevents the blade from rotating toward an open position once it has been closed.

It is also an object of the present invention to provide a damper operator which is simple in construction and reliable in use.

These and other objects will become apparent from the following detailed description, taken in conjunction with the following illustrations.

BRIEF DESCRIPTION OF THE DRAWINGS

In the several views provided, like reference numerals denote similar structure.

DETAILED DESCRIPTION OF THE PREFERRED EMBODIMENT

Figure 1:
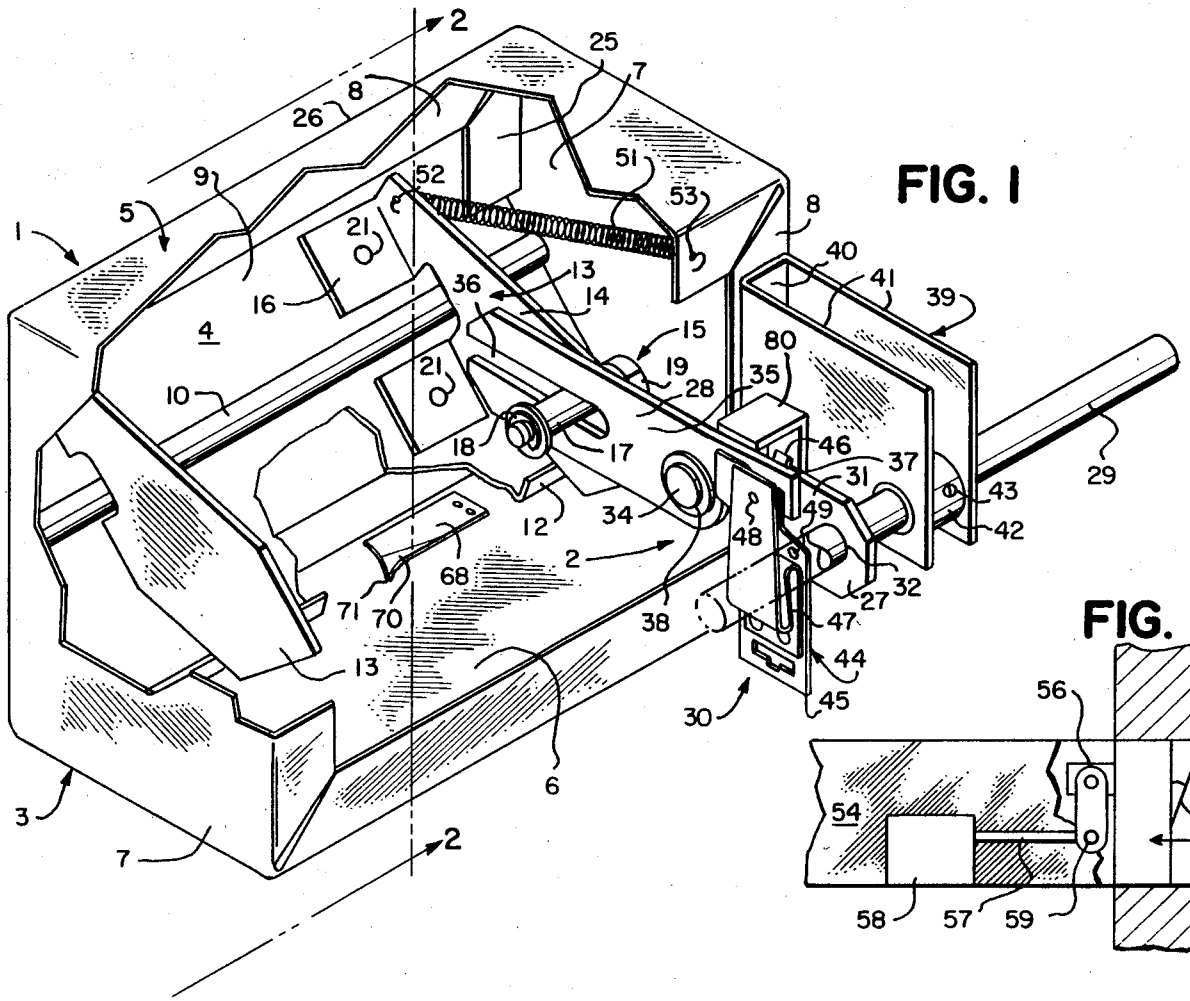
FIG. 1 is a perspective view of a damper and damper operator made in accordance with the preferred embodiment of my invention, portions of which have been broken away to show internal construction detail.

Although specific forms of the invention have been selected for illustration in the drawings, and the following description is drawn in specific terms for the purpose of describing these forms of the invention, this description is not intended to limit the scope of the invention which is defined in the appended claims.

FIG. 1 illustrates a damper designated generally 1 which has been provided with a peferred embodiment damper operator designated generally 2 in accordance with the present invention. The damper 1 is a small, single blade-type damper, which has been selected for illustrative purposes only, it being fully understood that the damper operator of the present invention can also be used with dampers having other sizes, shapes and constructions. The damper 1 selected for illustration in the drawings generally comprises a frame 3, and a damper blade 4 journalled for rotation within the frame 3.

Figure 2:
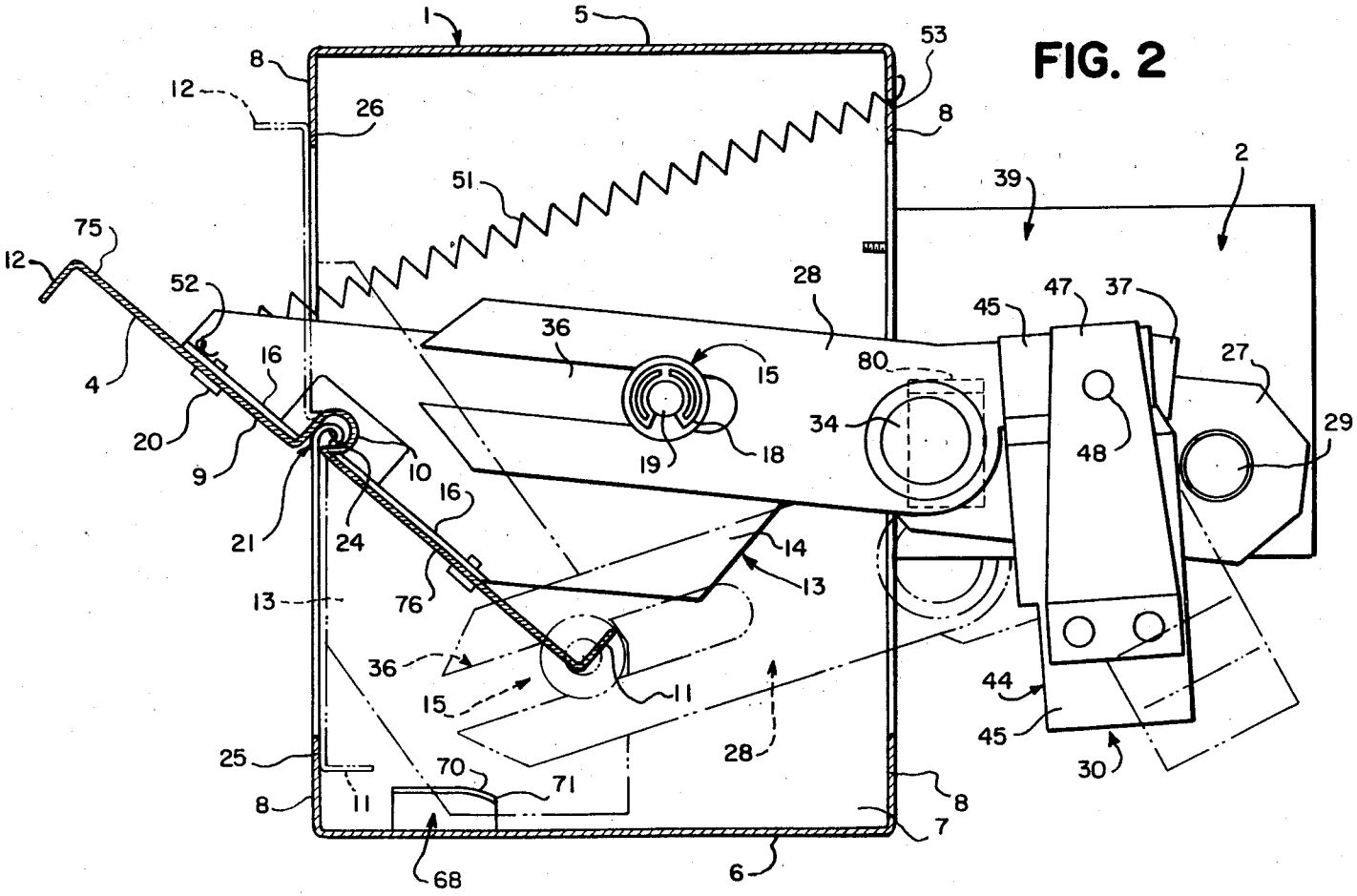
FIG. 2 is a cross-sectional view of the damper, taken as indicated by the lines and arrows 2—2 in FIG. 1, which shows the damper blade in its open position in full lines and in its closed position in phantom lines.

The frame 3 generally includes a top 5, a bottom 6, and two sides 7, which combine to form an enclosure for the damper blade 4. The dimensions of this enclosure are generally selected to substantially correspond to the dimensions of the duct into which the damper 1 is to be installed. Preferably, those portions of the periphery of the frame 3 which are adjacent the damper blade 4 include a flange 8 which extends inwardly toward the center of the damper 1. A similar flange 8 may also be provided along the remaining portions of the periphery of the frame 3, if desired, as illustrated in FIGS. 1 and 2.

The damper blade 4 generally includes a face 9, and a bracket 13 which is attached to blade 4 and extends rearwardly from the face 9. The face 9 of the damper blade 4 is substantially planar and includes a centrally disposed hinge 10, and flanged edges 11, 12 (FIG. 2). The bracket 13 includes a substantially planar surface 14, one end of which is provided with a camming mechanism 15, and the other end of which is provided with a mounting surface 16. A variety of devices may be used as the camming mechanism 15, one example being the device illustrated in the drawings, which includes a ferrule 17 extending outwardly from the surface 14 of the bracket 13, and a lock-washer 18 and pin 19 extending through the ferrule 17, to retain the ferrule 17 to the bracket 13. The mounting surface 16 includes two portions which contact the damper blade 4, so that appropriate attachment means, such as the rivets 20 illustrated, may be used to attach each portion of the mounting surface 16 to the damper blade 4.

The damper blade 4 is journalled for rotation within the frame 3 by a plurality of mounting brackets 21 associated with the flange 8 of the frame 3. Each mounting bracket 21 includes a hinge engaging element 24 which engages with the hinge 10 of the damper blade 4. In this manner, the damper blade 4 is permitted to freely rotate between a fully open and fully closed position as illustrated.

Orientation of the damper blade 4 within the damper 1 is controlled by the camming mechanism 15 operatively associated with the bracket 13, in a manner which will be more fully described hereinafter. In the fully open position, it is preferred that the damper blade 4 provide a minimum restriction to the air flow through the damper 1. This is assured by orienting the face 9 of the damper blade 4 so that it is substantially parallel to the air flow through the damper 1. In the closed position, it is preferred that the flanged edges 11, 12 of the damper blade 4 contact the flange 8 of the frame 3, to provide a sealed closure (as shown in phantom lines in FIG. 2). In order to assure proper closure, while assuring free rotation of the blade 4 within the damper 1, one of the flanged edges 11 is directed inwardly toward the center of the damper 1 so that those portions of the face 9 of the damper blade 4 adjacent the flanged edge 11 are positioned adjacent inner portions 25 of the flange 8, while the other flanged edge 12 is directed outwardly from the damper 1 so that those portions of the blade 4 adjacent the flanged edge 12 are positioned adjacent outer portions 26 of the flange 8.

The damper operator 2 generally comprises a drive rod 29; a pair of lever arms 27, 28 which are pivotally associated with each other and which extend between the drive rod 29 and the camming mechanism 15 of the damper blade 4; and a latching mechanism 30 which extends between selected portions of each of the lever arms 27, 28.

Figure 3:
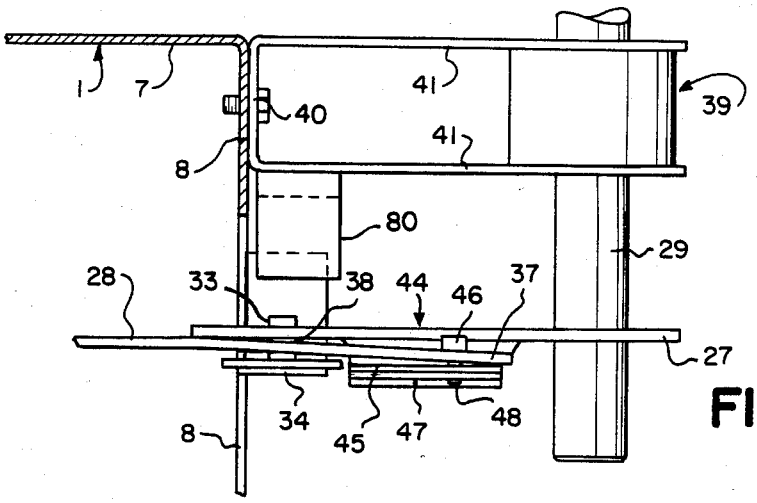
FIG. 3 is a partial, top plan view of the damper of FIG. 2, portions of which have been broken away to show internal construction detail.

As is best illustrated in FIG. 3, the drive rod 29 extends transversely outwardly from a position adjacent the interior of the damper 1, through a support bracket 39, to a position located beyond the side 7 of the damper frame 3. The support bracket 39 includes a base 40, and opposing sides 41 which engage the drive rod 29. The base 40 of the support bracket 39 is attached to the flange 8 of the damper frame 3, thus maintaining the drive rod 29 in its desired orientation. To prevent transverse movement of the drive rod 29 within the mounting bracket 39, a locking bearing 42 is located between the sides 41 of the mounting bracket 39, and around the drive rod 29. A set screw 43 can then be used to maintain proper engagement between the drive rod 29, and the locking bearing 42.

The lever arm 27 is provided with an aperture at each end. A first aperture 32 has a diameter which substantially corresponds to the diameter of the drive rod 29. Upon assembly, the lever arm 27 is fixedly attached to the drive rod 29, so that rotation of the drive rod 29 will cause rotation of the lever arm 27. The second aperture 33 (FIG. 3) is sized to accept an appropriate pivoting mechanism, such as the rivet 34 illustrated, to pivotally attach the lever arm 27 to the lever arm 28.

The lever arm 28 is provided with a longitudinally extending U-shaped slot 36 extending longitudinally from one end and a blade 37 at the other end. The lever arm 28 is also provided with an aperture 38 for receiving the rivet 34 which pivotally connects the lever arms 27, 28 to each other. The slot 36 of the lever arm 28 has a width which is preferably slightly larger than the diameter of the ferrule rule 17 of the camming mechanism 15. During assembly, the slot 36 is positioned to engage the ferrule 17, so that rotation of the damper operator 2 causes rotational movement of the bracket 13 of the damper blade 4, thereby moving the damper blade 4 to its desired position. As the bracket 13 is rotated, the ferrule 17 is permitted to slide along the slot 36 of the lever arm 28, thereby assuring free movement of the damper operator 2 and damper blade 4 with respect to each other. It is preferable to engage the ferrule 17 within the slotted enclosure shown.

Figure 5:
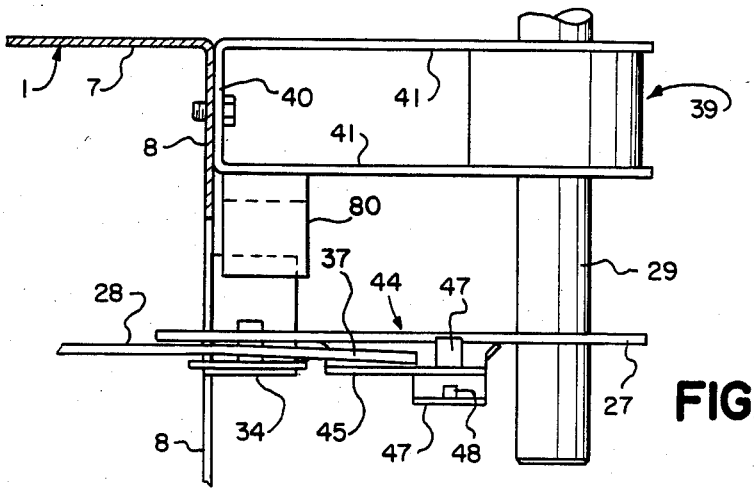
FIG. 5 is a partial, top plan view of the damper of FIG. 4, portions of which have been broken away to show internal construction detail.
Figure 4:
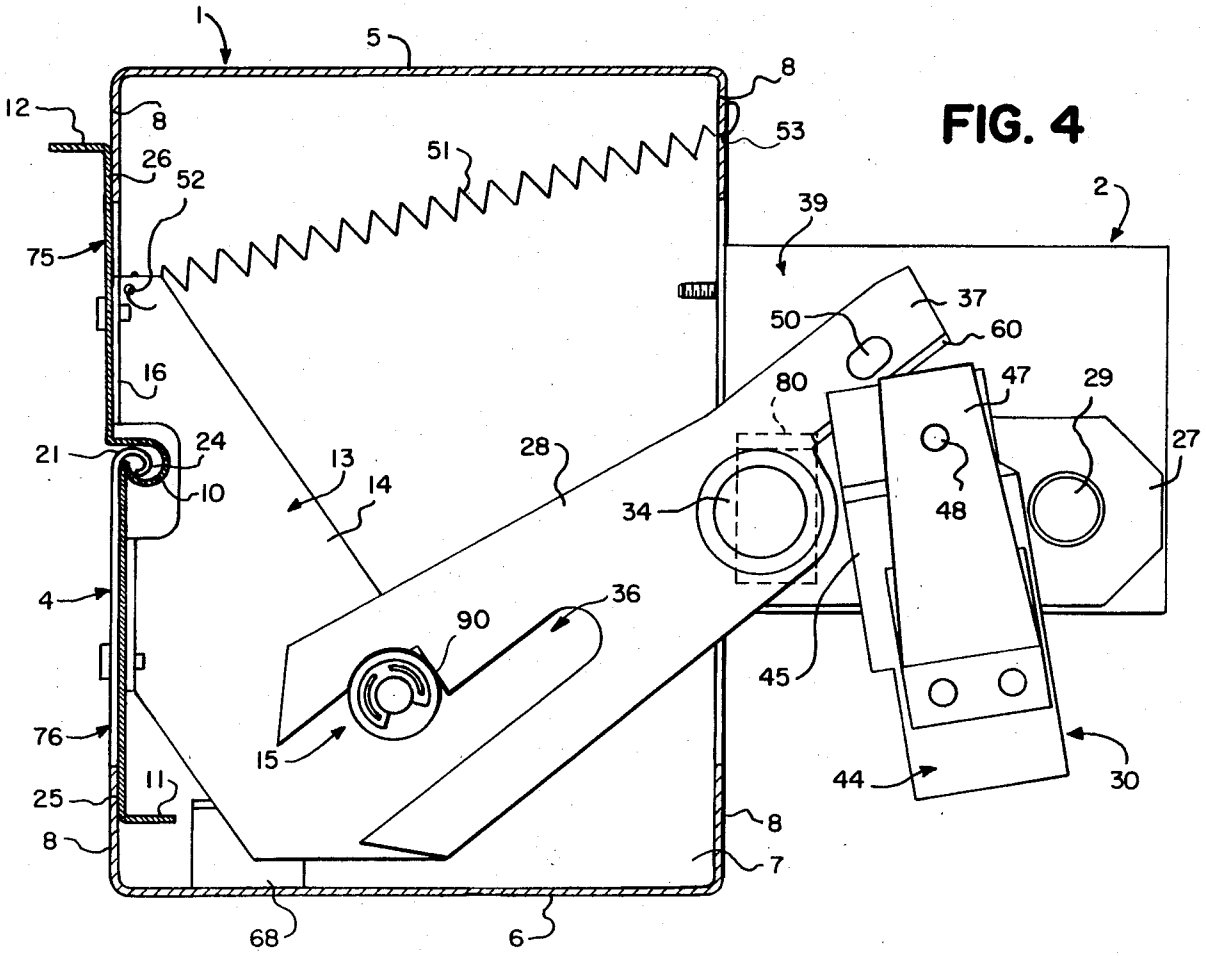
FIG. 4 is a cross-sectional view of an alternative embodiment similar to that of FIG. 2, but which shows the damper blade in its closed position, after release of the articulating assembly.

The latching mechanism 30 regulates respective movement between the lever arms 27, 28. During normal operating conditions, the latching mechanism 30 prevents the lever arm 28 from rotating with respect to the lever arm 27, so that rotation of the drive rod 29 operates the damper blade 4, as illustrated in FIG. 2 by comparing the full lined lever arm 28 with the position of the phantom lined lever arm 28. When a selected stimulus is encountered, such as the heat or smoke of a fire, the latching mechanism 30 releases, permitting the lever arm 28 to rotate with respect to the lever arm 27, which permits the damper blade 4 to be urged toward a selected orientation, as illustrated in FIGS. 4 and 5.

A variety of latching mechanisms 30 may be used to control respective movement between the lever arms 27, 28. One preferred latching mechanism which can be used for this purpose, as illustrated in FIGS. 1–5, is a heat actuated link of the type disclosed in my prior U.S. Pat. No. 3,889,314, dated June 17, 1975, the subject matter of which is incorporated herein by reference. Such a latching mechanism 44 generally includes a base plate 45 having a notch 46 spaced away from and substantially parallel to the base plate 45, and a serpentine, bimetallic element 47, one end of which is attached to the base plate 45 and the other end of which is provided with a latch 48 which extends through the notch 46 to the base plate 45. For use in conjunction with the damper operator 2 illustrated in FIGS. 1–5, the base plate 45 of the latching member 44 is attached directly to the lever arm 27 using, for example, the rivets 49 illustrated. The latching mechanism 44 is positioned on the lever arm 27 so that the latch 48 and the notch 46 are aligned with portions of the blade 37 of the lever arm 28. The blade 37 of the lever arm 28 is provided with an aperture 50 which is sized to receive the latch 48.

Accordingly, during normal operating conditions, the latch 48 extends fully through the notch 46 to the base plate 45 of the latching member 44, so that the blade 37 of the lever arm 28 is positively engaged, preventing respective movement between the lever arms 27, 28. Since the element 47 is formed of a bimetallic material, when the element 47 encounters a source of heat, the element 47 will expand, which draws the latch 48 out of the aperture 50 of the blade 37. This releases the blade 37, thereby permitting the lever arm 28 to pivot with respect to the lever arm 27. This, in turn, frees the camming mechanism 15 associated with the damper blade 4, which permits the damper blade 4 to rotate within the damper frame 3. By attaching a spring 51 lever between an aperture 52 in the bracket 13 and an aperture 53 the flange 8 of the damper frame 3, the damper blade 4 is caused to move to its closed position. Closure of the damper blade 4 is limited by contact between the flanged edges 11, 12 of the damper blade 4 of the flange 8 of the damper frame 3 as previously described.

Figure 8:
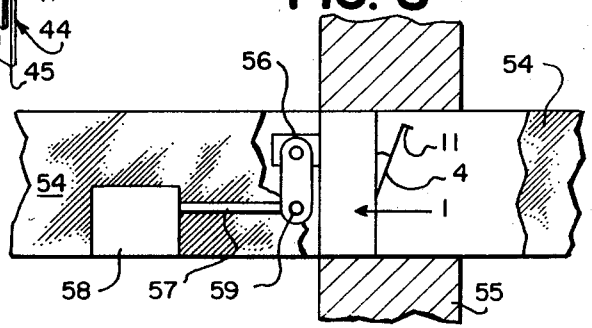
FIG. 8 is a partial, side elevational view illustrating installation of the damper and damper operator of the present invention in a duct.

FIG. 8 illustrates one manner in which the damper illustrated in FIGS. 1–5 can be installed in a duct 54. As illustrated, the duct 54 extends through a firewall 55. It is therefore desirable to position the damper 1 directly within those portions of the duct 54 which extend through the firewall 55, without having to modify the structure of the duct 54. The damper 1 and damper operator 2 of the present invention permit this to be done, irrespective of the height of the damper, since the damper operator 2 is capable of operating in small spaces. Installation is accomplished by positioning the damper 1 within the duct 54 so that the frame 3 of the damper 1 is positioned within the firewall 55, and so that the support bracket 39 for the drive rod 29 extends rearwardly from the firewall 55 as shown. In this manner, the damper structure is accommodated within the duct 54, without having to modify the duct, and the drive rod 29 is free to extend outwardly from the duct 54 without interfering with the installation. A drive arm 56 is then attached to the drive rod 29, so that the drive shaft 57 (or cable) of an actuator 58 can engage the drive arm 56 at an appropriate pivot 59.

During normal operating conditions, the latch 48 of the latching mechanism 44 engages the blade 37 of the lever arm 28, so that the lever arms 27, 28 are prevented from rotating with respect to each other. In this manner, rotation of the drive rod 29 causes rotation of the lever arms 27, 28, thereby rotating the damper blade 4 into a position regulated by operation of the actuator 58. This condition will continue until such time as a selected stimulus, such as the heat of a fire, is encountered. The presence of heat in the vicinity of the latching mechanism 44 causes the bimetallic element 47 of the latching mechanism 44 to expand, pulling the latch 48 from the aperture 50 in the blade 37 of the lever arm 28. This frees the lever arm 28 for pivotal movement with respect to the lever arm 27. As a result, the damper blade 4 is drawn toward its closed position by the spring 51, thereby closing the damper and sealing the duct 54 with which it is associated, providing the function of a fire damper.

The damper 1 remains in its closed position until it is reset, which can be accomplished as follows. When the source of heat is removed from the vicinity of the latching mechanism 44, the bimetallic element 47, and the latch 48, are returned to their original position, which causes the latch 48 to advance through the notch 46 to the base plate 45. To reset the damper, the damper blade 4 may be manually rotated toward its open position, or the actuator 58 may be operated in a manner which urges the drive rod 29 and lever arm 27 toward the position which those elements would normally assume to close the damper blade 4, until the lower edge 60 of the blade 37 is brought into contact with the latch 48 of the latching mechanism 44. By providing the lower edge 60 with a sloping surface, the latch 48 is forced outwardly until the aperture 50 of the blade 37 is brought into alignment with the latch 48, whereupon the latch 48 will be urged into the aperture 50, preventing further respective movement between the lever arms 27, 28. The damper 1 is then ready to resume normal operation, as previously described.

If desired, such a resetting function can also be provided by incorporating a reset arm (not shown) into the damper operator 2 which is capable of rotating the blade 37 of the lever arm 28 into alignment with the latch 48 as previously described. Such a reset arm may even be used to reset the damper operator 2 from a position external to the duct 54, if desired.

When the arms are latched together and being rotated by the rod 29 in a clockwise direction when viewed as in FIG. 1, so as to vary the orientation of the blade 4 toward a more open position, it is desirable to provide a stop means 80 which will prevent the arms from being rotated to such an extent that the U-shaped slot 36 would disengage from the ferrule 17. Other means for preventing this occurance include providing sufficient length to the arms and positioning of the parts with respect to one another so that the travel in the clockwise direction can never result in the disengagement between the ferrule and the slot.

It is desirable to latch the damper blade 4 in its closed position, so that pressure which is created in the duct during the occurance of a fire cannot force the damper blade 4 open. In order to provide this function, a cut-out portion 90 is provided in the arm 28 (FIG. 4) having most preferably a surface complimentary to the surface of the ferrule 17. Most preferably, the surface is extensive enough so that on fully closing the damper, the ferrule will be juxtaposed with respect to the arm such that the line of force applied by the ferrule against the arm will be over-center with respect to the axis of the pivot between the first and second arms, thus tending to hold the blade in the closed position against this force.

It is noteworthy that this mechanism will not prevent the arms from being re-latched in response to rotation of the rod 29.

As an alternate means for providing this function, a locking clip 68 may be used. The locking clip 68 is preferably formed of a bimetallic material and is preferably attached directly to the bottom 6 of the frame 2 using, for example, the rivets illustrated. During normal operating conditions, the locking clip 68 extends along the bottom 6 of the frame 3, so that the locking clip 68 does not interfere with operation of the damper blade 4. However, when the heat of a fire is present, the locking clip 68 is caused to swing upwardly into the path of the damper blade 4, preventing it from being forced open. To enhance operation of the locking clip 68, it is preferred that the surface of the locking clip 68 be provided with two chamfers 70, 71. The first chamfer 70 is relatively long and gradual, while the second chamfer 71 is relatively short and steep. The chamfers 70, 71 are provided to assure that the damper blade 4 closes over the locking clip 68, even if the locking clip 68 has already partially extended into the path of the damper blade 4 before it has closed. Of course, after the fire has subsided, the locking clip 68 will cool and retract to its original position, adjacent the bottom 6 of the frame 3, freeing the damper blade 4 for continued operation.

It may therefore be seen that the foregoing damper 1 and damper operator 2 serve well to satisfy the several objectives previously set forth. However, it may also be seen that these components can be modified without departing from the present invention. For example, the damper operator of the present invention may be used in conjunction with a variety of dampers, not just the damper 1 illustrated in the drawings. It is even possible for the damper operator 2 of the present invention to be used in conjunction with larger dampers if desired. However, this is considered to be less desirable since the damper operator 2 of the present invention does not provide the same mechanical advantage as the damper operators which are currently used in conjunction with larger dampers.

Figure 7:
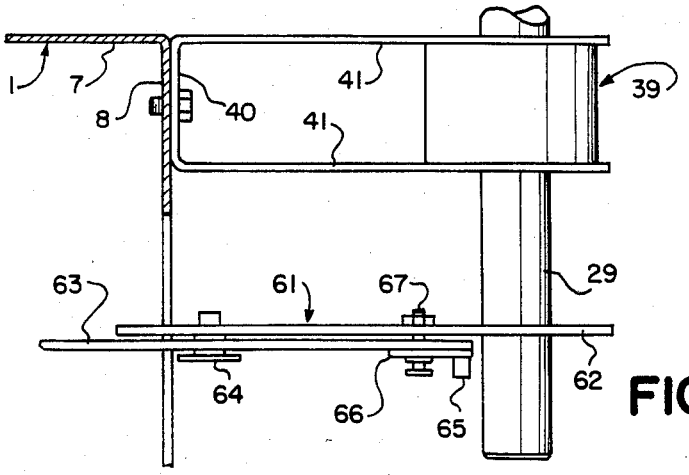
FIG. 7 is a partial, top plan view of the damper of FIG. 6, portions of which have been broken away to show internal construction detail.
Figure 6:
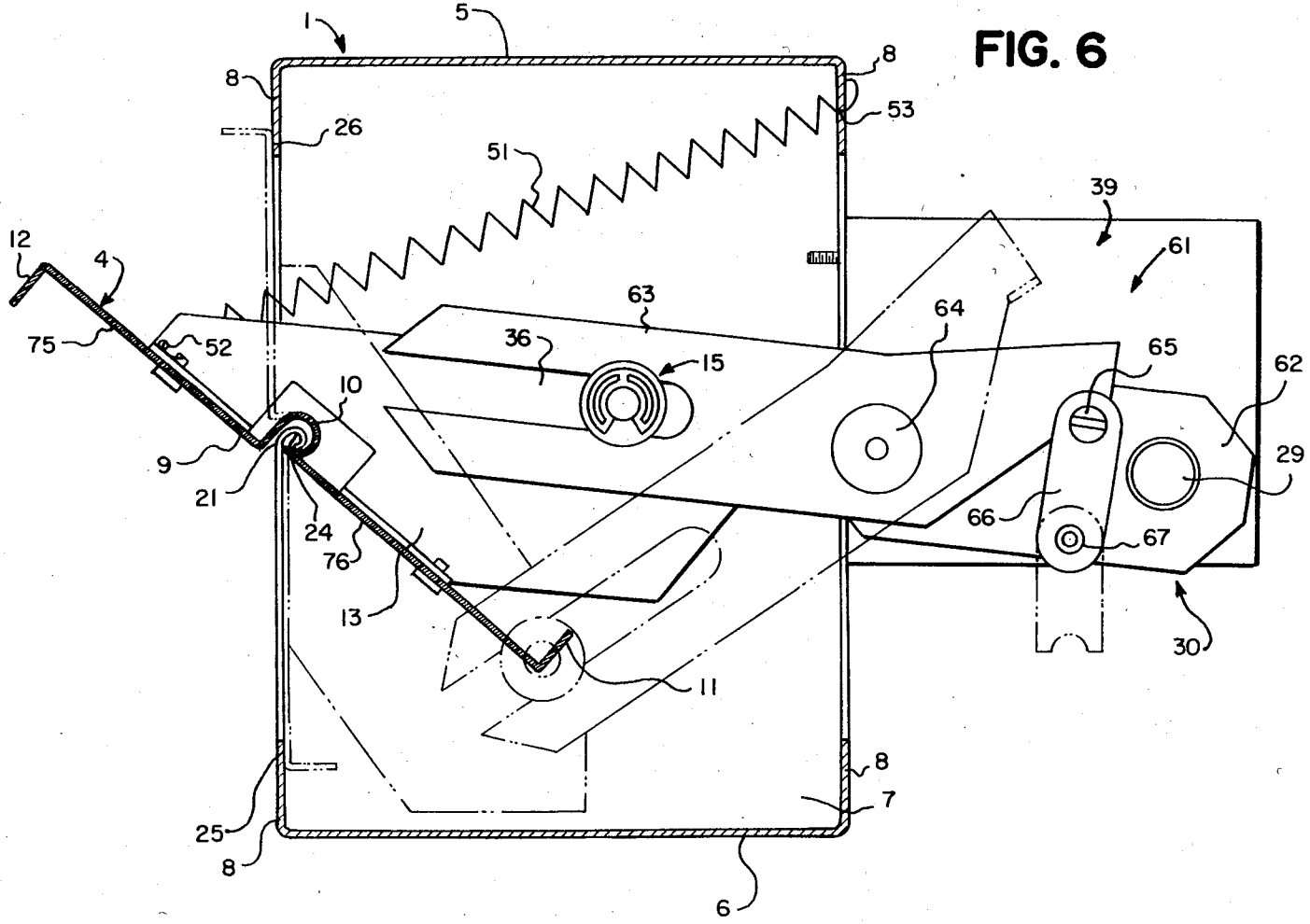
FIG. 6 is a cross-sectional view similar to FIG. 1 of a damper which has been provided with an alternative embodiment damper operator.

The structure comprising the damper operator 2 of the present invention can also be modified, so long as a mechanism is provided for assuring selective pivotal rotation between the lever arms 27, 28 in response to a selected stimulus. One example of an alternative embodiment damper operator which may be used for this purpose is illustrated in FIGS. 6 and 7. As before, the damper operator 61 includes a pair of lever arms 62, 63 which are attached for pivotal rotation with respect to each other about the rivet 64, and which extends between the drive rod 29 and the camming mechanism 15 operatively associated with the damper blade 4 as previously described. The lever arms 62, 63 substantially resemble the lever arms 27, 28, except for two differences. First, a hooked end portion 65 is substituted for the blade 37 which was associated with the lever arm 28. Second, a fusible link 66 is substituted for the latching mechanism 44 previously described. The fusible link 66 is attached between the hooked end 65 of the lever arm 63 and a bolt 67 extending from the lever arm 62. As result, during normal operating conditions, respective movement between the lever arms 62, 63 is prevented. When a source of heat is encountered, the fusible link 66 separates, which permits the lever arm 63 to rotate with respect to the lever arm 62, thereby freeing the damper blade 4 for pivotal movement as previously described. To reset the damper operator 2 for renewed operation, a new fusible link 66 is installed, as previously described.

Other latching mechanisms may also be used. For example, electrically operated devices may be used to provide for selective engagement between the lever arms of the damper operator, if desired. One way in which this may be accomplished is to provide the bimetallic element 47 of the latching mechanism 44 with an electrically heated pad, which permits operation of the latch 48 to be controlled in response to an electrical signal. An example of a mechanism which can be used for this purpose may be found in my U.S. Pat. No. 3,725,972, dated Apr. 10, 1973, and entitled "Fire Link and Method of Actuating Same", the subject matter of which is incorporated herein by reference.

The damper 1 illustrated in FIGS. 1–8 has been provided with a damper operator which provides the function of a fire damper, one which closes upon detecting the presence of heat from a fire. However, the damper operator of the present invention may also be used to provide the function of a smoke damper if desired, one which fully opens upon sensing the presence of smoke. To do so, all that need be done is to provide the damper with a spring which urges the damper blade 4 toward a fully open position, and to suitably modify the release mechanism so that the lever arm 28, 63 is free to rotate to a position which permits the damper blade 4 to be urged toward its fully open position by the spring associated with the damper.

Lastly, throughout the foregoing description, the lever arms of the damper operator have extended between a rotatable damper blade and a rotatable drive assembly. This permits the damper to be operated as a control damper during normal operating conditions. However, it is not necessary for the damper operator of the present invention to provide the function of a control damper. It is also possible for the damper operator of the present invention to be used to provide only the function of a fire or smoke damper, if desired for a particular application. To do so, the end of the lever arm 27, 62 which is normally provided with the aperture 32 is fixedly attached to the damper frame 3, or a mounting bracket extending from the damper frame 3. Upon sensing the heat or smoke of a fire, operation of the damper operator would proceed as previously described.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. In a damper having a frame and at least one blade pivotally associated with the frame, the improvement comprising:

a. an actuator means for varying the orientation of the blade within the frame comprising:
   (i) a first arm movably mounted with respect to said frame;
   (ii) a second arm pivotally associated with the first arm and extending between the first arm and means associated with the blade of the damper to move said blade;
   (iii) means for biasing the blade toward a selected orientation;
   (iv) means for selectively interconnecting portions of the first and second arms, so that the first and second arms are prevented from rotating with respect to each other in a first mode of operation, and so that the first and second arms are permitted to rotate with respect to each other to permit the blade to rotate toward the selected orientation, in a second mode of operation; and
   (v) means on said second arm to selectively prevent the counter-rotation of the blade once it has been moved to the selected orientation in the second mode of operation.

2. The damper of claim 1 wherein the actuator means is pivotally associated with the damper, so that the blade is movable between a fully open and fully closed position in response to movement of said first arm in a first mode of operation.

3. The damper of claim 2 wherein the actuator means comprises a drive rod fixedly attached to the first arm and extending parallel to the axis of the blade and mounted for rotational movement about its axis, and a means is provided to prevent disengagement of the second arm from the means associated with said blade upon rotation of said drive rod.

4. The damper of claim 1 wherein the second arm includes means for slidingly engaging a means operatively associated with the blade to pivot said blade and vary its orientation within the frame.

5. The damper of claim 4 wherein the means operatively associated with the blade is a ferrule extending from a bracket attached to and extending outwardly from the blade of the damper.

6. The damper of claim 4 wherein the engaging means is a longitudinally extending, U-shaped slot.

7. The damper of claim 1 wherein the means on said second arm comprises a surface juxtaposed with means on the damper blade, so that in the second mode of operation, the blade is prevented from moving to an open position once it has been moved to a closed position.

8. The damper of claim 1 wherein the biasing means is a spring extending between portions of the damper blade and portions of the frame of the damper.

9. The damper of claim 1 wherein the selectively interconnecting means comprises:

a. a bimetallic spring element, one end of which is attached to one of the arms of the damper operator, and the other end of which includes a latch portion; and b. a blade portion operatively associated with the other of the arms of the damper actuator, and having an aperture adapted to receive the latch portion of the bimetallic spring element.

10. The damper of claim 9 wherein the interconnecting means is electrically operated.

11. The damper of claim 10 wherein the bimetallic spring element further comprises electrically operated heating means operatively associated therewith.

12. The damper of claim 9 wherein the blade portion further includes a sloping surface for assisting interconnection between the blade portion and the latch portion.

13. The damper of claim 1 wherein the interconnecting means comprises a fusible link, one end of which is attached to one of the arms of the damper operator, and the other end of which engages a hooked end portion associated with the other of the arms of the damper operator.

14. The damper of claim 1 wherein the first arm is fixedly connected to the actuator means, the second arm is pivotally connected to the first arm, and the pivotal connection between the first arm and the second arm is radially spaced from the fixed connection between the first arm and the actuator means.

15. The damper of claim 14 wherein the interconnecting means is positioned between the pivotal connection between the first arm and the second arm and the fixed connection between the first arm and the actuator means.

16. The damper of claim 1 wherein the second arm has two ends, one of which is pivotally connected to the first arm, and the other of which engages the blade of the damper.

17. The damper of claim 16 wherein the first arm has two ends, one of which is fixedly associated with the actuator means, and the other of which is pivotally associated with the second arm.

18. The damper of claim 6 wherein the second arm has two ends, one of which is pivotally connected to the first arm, and the other of which incorporates the slot.

19. The damper of claim 18 wherein the slot in the second arm has a surface which engages means on the blade to prevent the opening of the blade once it has been closed in the second mode of operation.

20. For a damper having a frame, and a blade pivotally associated with the frame, an improved damper operator comprising:

a. drive means operatively associated with the frame of the damper;

b. a plurality of lever arms pivotally associated with each other and extending between the drive means and means for rotating the blade;

c. means for selectively interconnecting portions of each of the lever arms to each other so that selective engagement between the portions of the lever arms permits selective respective rotation of the lever arms, to permit the blade to be urged to a selected orientation; and d. means on one of said arms to selectively prevent counter-rotation of the blade once it has been rotated to a selected orientation.

21. For a damper having a frame, a blade pivotally associated with the frame, and actuator means for varying the orientation of the blade within the frame between a fully open and a fully closed position and comprising a drive rod pivotally associated with and extending transversely, outwardly from the frame of the damper, an improved damper operator comprising:

a. a first arm fixedly connected to and extending essentially radially from the actuator means;

b. a second arm, one end of which is pivotally connected to portions of the first arm radially spaced from the fixed connection between the first arm and the actuator means, and the other end of which incorporates a longitudinally extending, U-shaped slot for engaging a pivot associated with the blade of the damper;

c. means for biasing the blade toward a selected orientation;

d. means for selectively interconnecting portions of the first and second arms, positioned between the pivotal connection between the first arm and the second arm and the fixed connection between the first arm and the actuator means so that the first and second arms are prevented from rotating with respect to each other in a first mode of operation, and so that the first and second arms are permitted to rotate with respect to each other to permit the blade to rotate toward the selected orientation, in a second mode of operation; and e. a surface in the slot portion of the second arm disposed and configured to prevent the blade from opening when it has been closed in the second mode of operation.

* * * * *